US006609848B1

(12) United States Patent
Rosenberg

(10) Patent No.: US 6,609,848 B1
(45) Date of Patent: Aug. 26, 2003

(54) COMBINATION TOOTHBRUSH AND TOOTHPASTE DISPENSER

(76) Inventor: Dorothy J. Rosenberg, 28 Huntington Cir. Dr., Medford, NJ (US) 08655

( * ) Notice: Subject to any disclaimer, the term of this patent is extended or adjusted under 35 U.S.C. 154(b) by 0 days.

(21) Appl. No.: 10/138,832

(22) Filed: May 6, 2002

(51) Int. Cl.[7] ..... A46B 11/02

(52) U.S. Cl. ..... 401/148; 132/311; 401/195; 401/272

(58) Field of Search ..... 401/148, 272, 401/195, 52; 132/311

(56) References Cited

U.S. PATENT DOCUMENTS 4,957,125 A * 9/1990 Yaneza ..... 401/195 X 6,206,600 B1 * 3/2001 Rosenberg et al. ..... 401/272

* cited by examiner

*Primary Examiner*—David J. Walczak
*Assistant Examiner*—Kathleen J. Prunner

(57) ABSTRACT

A combination toothbrush and toothpaste dispenser is provided with a brush head, a brush head cover, a brush neck, a compression spring, a hollow cylindrical handle portion, a self rising bottom plate, a spring metal washer, and a floss retaining portion located at the bottom most area of the hollow handle. A floss cover plate covers the floss retaining portion. The metal washer has a plurality of radially extending fingers that frictionally engage the inner wall of the hollow handle portion. The compression spring is installed around the brush neck so that the brush neck is forced in an upward direction unless pressed by a user. The metal washer is fixedly attached to the underside of the self rising plate so that, as toothpaste is released on the brush head, the bottom plate and the spring washer rise.

3 Claims, 4 Drawing Sheets

COMBINATION TOOTHBRUSH AND TOOTHPASTE DISPENSER

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of toothbrushes and more specifically to an improved combination toothbrush and toothpaste dispenser.

Toothbrushes for cleaning one's teeth are commonly known. They are comprised of a handle portion and a brush head portion.

Over the years, various inventors have proposed improvements to the standard toothbrush. Some include the concept of storing toothpaste in a hollow handle portion and by various means, making the toothpaste communicate with the bristle portion of the head. These improvements include my own design as can be seen in my U.S. Pat. No. 6,206,600 issued on Mar. 27, 2001.

However, I have developed even more unique variations and improvements to my design that make the production and use of a combination toothbrush and toothpaste dispenser even more appealing.

BRIEF SUMMARY OF THE INVENTION

The primary object of the invention is to provide a toothbrush that contains a stored amount of toothpaste within its handle.

Another object of the invention is to provide a toothbrush that allows the user to apply toothpaste to the brush by pushing down on the top of the toothbrush head.

Another object of the invention is to provide a toothbrush where the toothpaste is conveniently stored within a cylindrical handle portion of the toothbrush.

A further object of the invention is to provide a toothbrush where the amount of toothpaste stored within the brush handle lasts for approximately two months whereupon the user dispenses the entire toothbrush assembly.

Another object of the invention is to provide an improved pumping and dispensing means.

Another object of the invention is to provide an improved design that is easier and less expensive to manufacture.

Another object of the invention is to provide a unique, less viscous type of toothpaste that makes it easier to dispense.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a combination toothbrush and toothpaste dispenser comprising: a brush head, a brush head cover, a brush neck, a compression spring, a hollow cylindrical handle portion, a self rising bottom plate, a spring metal washer, a floss retaining portion located located at the bottom most area of said hollow handle, a floss cover plate, said brush neck including a check valve, said brush neck and head having an internal hollow tubular channel that allows toothpaste stored within said hollow handle to travel to the bristle portion of said brush head, said metal washer having a plurality of radially extending fingers that frictionally engage the inner wall of said hollow handle portion, said compression spring installed around said brush neck so that said brush neck is forced in an upward direction unless pressed by the user, said metal washer fixedly attached to the underside of said self rising plate so that as toothpaste is released on said brush head said bottom plate and said spring washer rise, and said washer fingers being downwardly biased so that as said washer is drawn up, said washer is free to slide up but said washer can not be pushed down during said pumping action.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
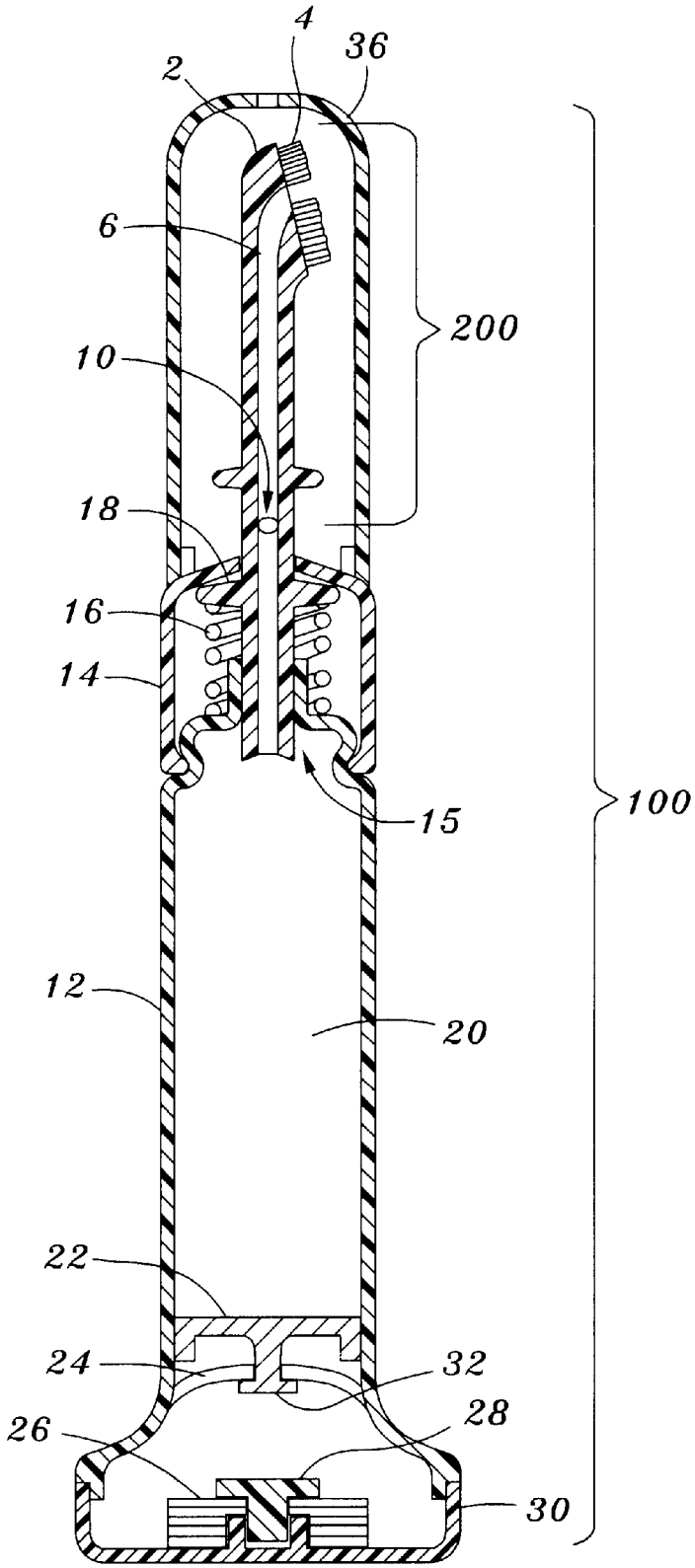
FIG. 1 is a side section view of the invention.
Figure 2:
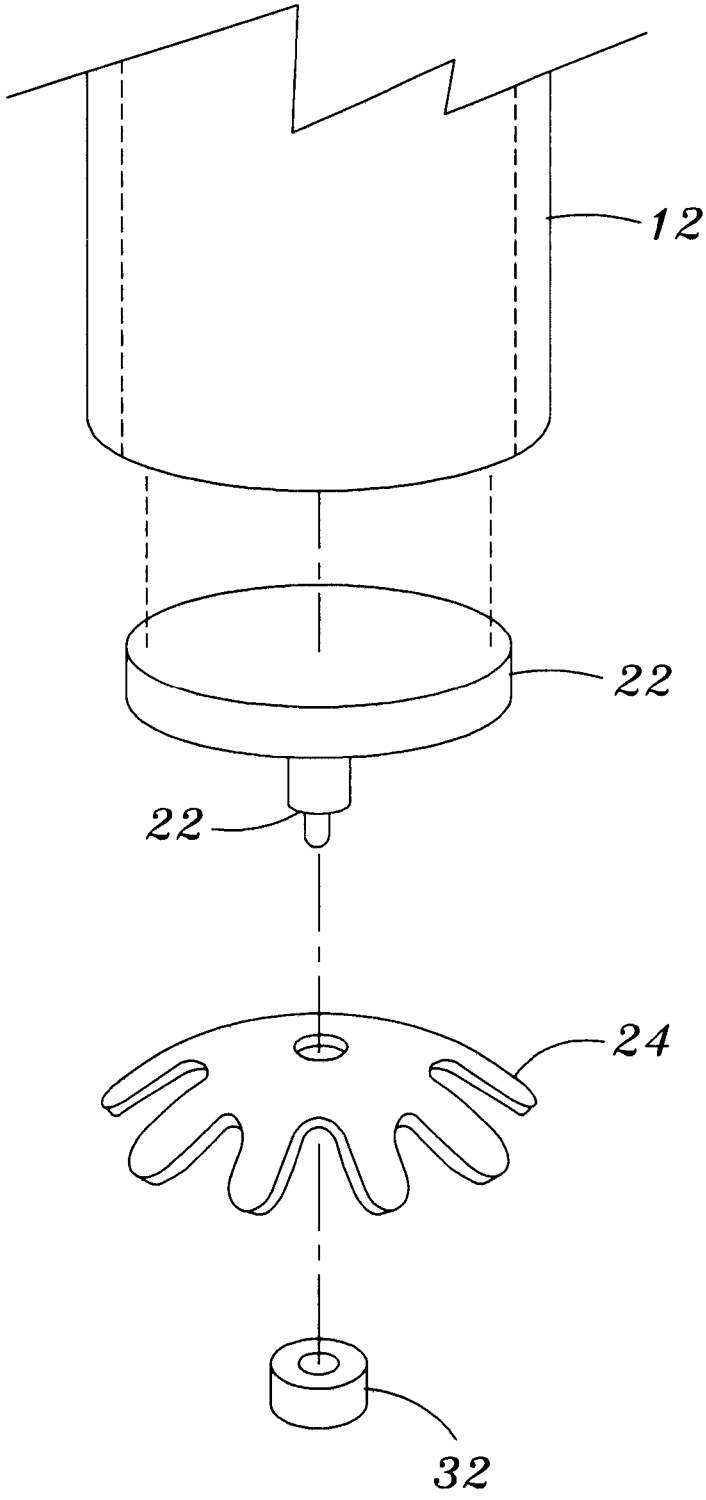
FIG. 2 is an exploded view of the spring washer portion of the invention.
Figure 3:
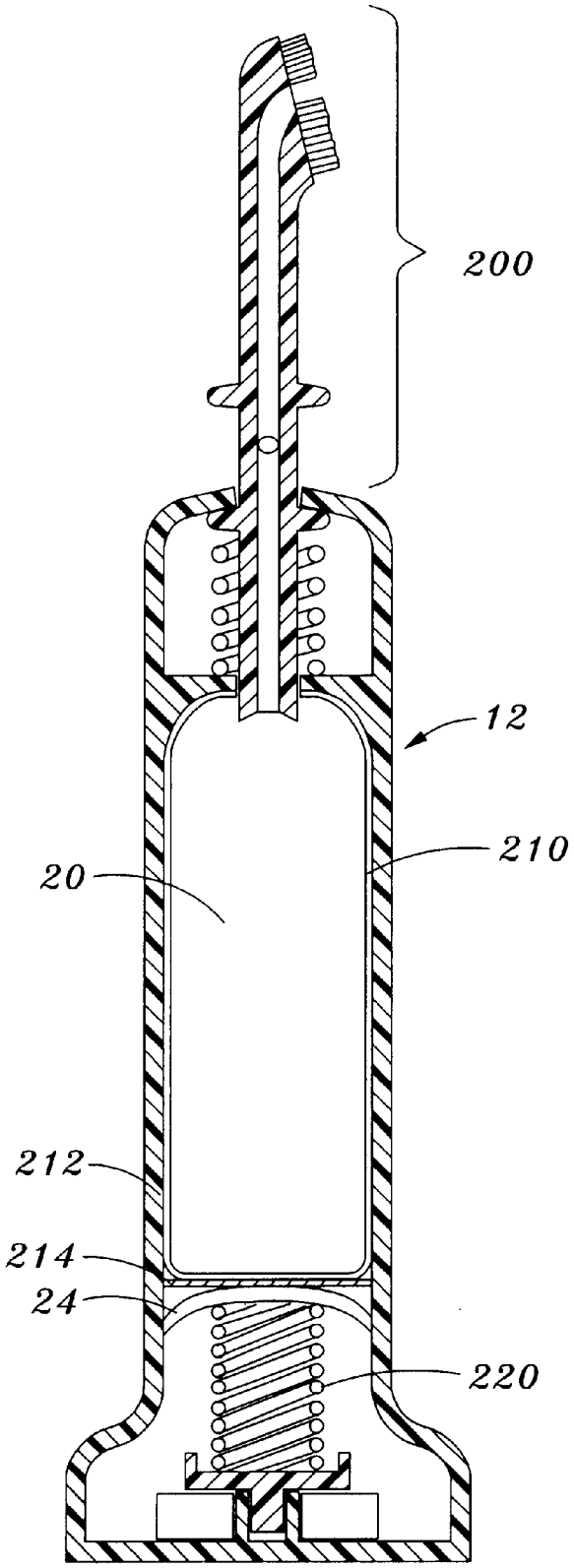
FIG. 3 is a side view of an alternate embodiment of the invention.
Figure 4:
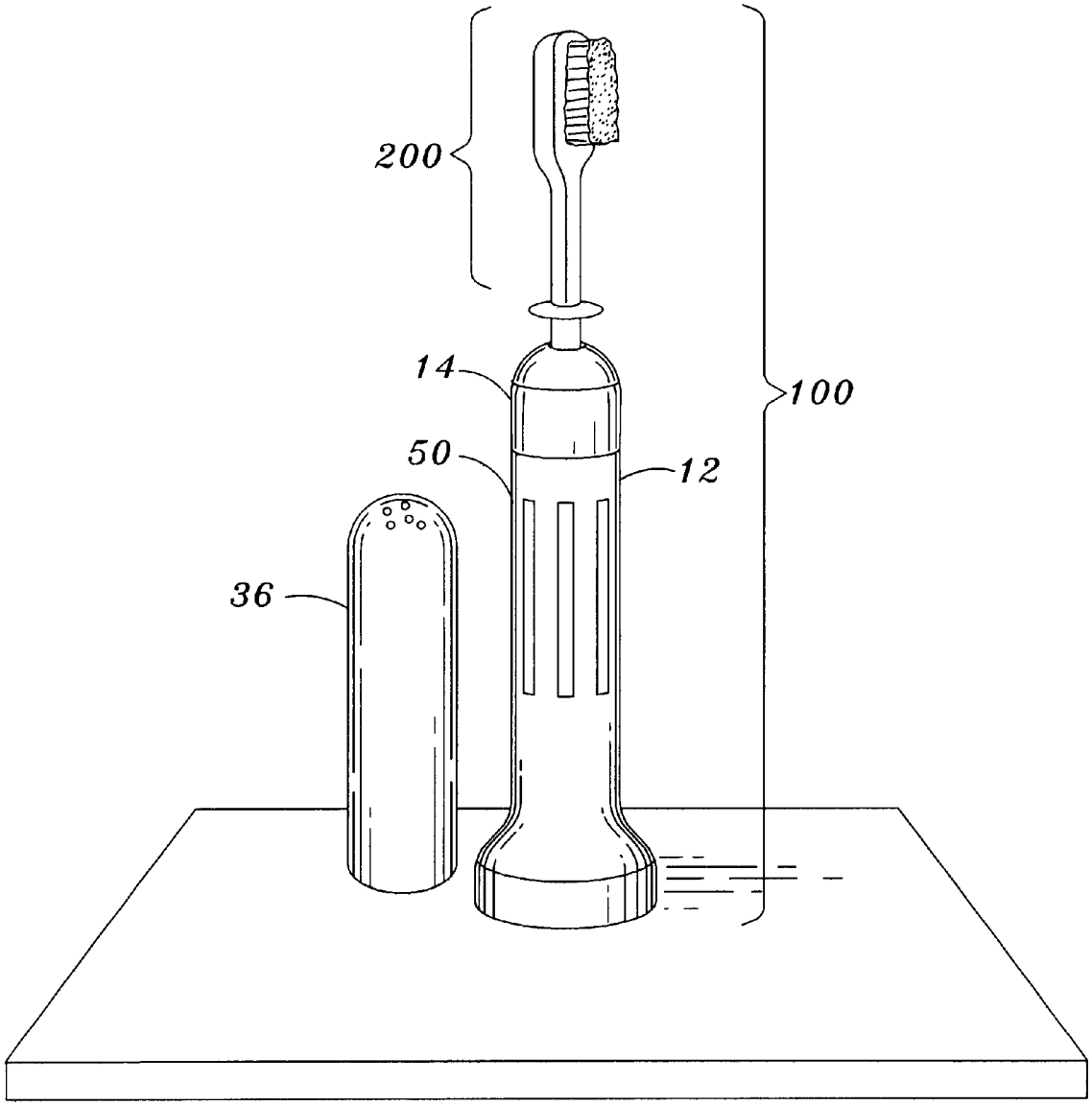
FIG. 4 is a perspective view of the present invention.

Referring now to FIG. 1 we see a side view of the combination toothbrush and toothpaste dispensing invention of the present invention 100. A brush head and neck assembly 200 slidably engages within the top aperture 15 of toothpaste holding tube 12. Tube 12 forms a hollow cylindrical handle portion with a floss retaining portion located at the bottom most area. An integral disk 18 retains compression spring 16. Hollow tubular collar 14 retains disk 18 thereby preventing the toothbrush assembly 200 from escaping upward. An internal hollow tubular channel or hollow cavity 6 is formed in the brush neck and travels from the base of assembly 200 to the bristle portion of assembly 200. A standard check valve 10 allows toothpaste 20 to travel up to the brush head 2 but not back down into tube 12. A self rising bottom plate 22 retains toothpaste 20. A spring metal washer 24 is fixedly retained or attached to the underside of the bottom plate 22. Lower cup shaped bottom cap 30 retains a standard roll of dental floss 26. Floss 26 is held in place by a cover plate or retainer cap 28. Removable and replaceable brush head cover or top cap 36 protects brush head 2 and attached bristles 4. FIG. 2 shows an exploded view of spring washer 24, slidable bottom plate 22 and tubular toothpaste enclosure 12. Spring washer 24 is comprised of a plurality of radially disposed fingers. The fingers are downwardly biased so that the washer 24 can slide upward but the fingertips dig into or frictionally engage the inner side wall of toothpaste holding tube 12 when downward pressure is applied. Cap 32 fixedly retains spring washer 24 to the underside of bottom plate 22. The side walls of bottom plate 22 are slidably engaged with the inner wall of tube 12 in such a way that no toothpaste 20 can pass by bottom plate 22 thereby forcing all the contained toothpaste 20 in an upward direction only. Toothpaste holding tube 12 is constructed of injection molded polyethylene and, although semi-rigid in nature, the relatively soft nature of the wall of tube 12 allows the fingers of spring washer 24 to dig into the wall. The construction described herein is easy and inexpensive to manufacture. The pumping action occurs when a user presses down on the top of brush head 2, toothpaste 20 is forced up into hollow cavity 6 and out into the area of bristles 4. Upon the upward stroke of head assembly 200, the vacuum created in tube 12 draws plate 22 up. The next time the user presses down on brush head 2 the fingers of spring washer 24 dig into inner wall of tube 12 as described above thereby forcing out more toothpaste as described above. Toothpaste 20 contained within tube 12 is preferably a gel type and can be made less viscous by the addition of a thinning liquid such as food grade mineral oil which will make the toothpaste 20 flow more easily through channel 6 and out into bristles 4. Thinning provides a more free flowing toothpaste than is normally available. FIG. 3 shows an alternate embodiment where a plastic bag 210 contains toothpaste 20. In this embodiment a compression spring 220 pushes up lightly on a base plate 214 and attached spring washer 24 which in turn keeps bag 20 in compression. This embodiment allows the hollow housing 212 to be molded in two longitudinal halves which can then be welded or otherwise attached together. FIG. 4 is a perspective view of the present invention 100 showing its essentially tubular construction. Protective cover 36 is shown to the left of the main assembly. A plurality of rubberlike insert strips 50 surround the outer wall of tube 12 and help a user to grip the invention 100 without slippage.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A combination toothbrush and toothpaste dispenser comprising:

a brush head having a bristle portion;

brush head cover;

a brush neck;

a compression spring;

a hollow cylindrical handle portion in which toothpaste is stored within the hollow defined by an inner wall of the handle portion;

a self rising bottom plate;

a spring metal washer;

a floss retaining portion located at the bottom most area of said hollow handle portion;

a floss cover plate;

said brush neck including a check valve;

said brush neck and head having an internal hollow tubular channel that allows the toothpaste stored within said hollow handle portion to travel to the bristle portion of said brush head;

said metal washer having a plurality of radially extending fingers that frictionally engage the inner wall of said hollow handle portion;

said compression spring installed around said brush neck so that said brush neck is forced in an upward direction unless pressed by a user;

said metal washer fixedly attached to the underside of said self rising plate so that, as toothpaste is released on said brush head, a pumping action begins and said bottom plate and said spring washer rise; and said washer fingers being downwardly biased so that as said washer is drawn up, said washer is free to slide up but said washer can not be pushed down during said pumping action.

2. The combination toothbrush and toothpaste dispenser of claim 1 wherein a thin walled flexible plastic bag stores said toothpaste within said handle portion and a second compression spring is located under said bag to push said bag and its contents upward as said toothpaste is released and removed from said bag.

3. The combination toothbrush and toothpaste dispenser of claim 1 wherein said toothpaste is thinned with mineral oil in order to make a more free flowing toothpaste than is normally available.

* * * * *